US007674520B2

(12) United States Patent
Schier

(10) Patent No.: US 7,674,520 B2
(45) **Date of Patent: *Mar. 9, 2010**

(54) PVD COATED CUTTING TOOL

(75) Inventor: Veit Schier, Echterdingen (DE)

(73) Assignee: Sandvik Intellectual Property AB, Sandviken (SE)

( * ) Notice: Subject to any disclaimer, the term of this patent is extended or adjusted under 35 U.S.C. 154(b) by 714 days.

This patent is subject to a terminal disclaimer.

(21) Appl. No.: 11/513,340

(22) Filed: Aug. 31, 2006

(65) Prior Publication Data

US 2007/0059558 A1 Mar. 15, 2007

(30) Foreign Application Priority Data

Sep. 9, 2005 (SE) ..... 0502001

(51) Int. Cl.
*B32B 9/00* (2006.01)

(52) U.S. Cl. ..... 428/216; 51/307; 51/309; 204/192.1; 204/192.15; 407/119; 427/348; 427/368; 427/419.1; 427/419.2; 427/419.3; 427/419.7; 428/156; 428/178; 428/336; 428/472; 428/697; 428/698; 428/699; 428/701; 428/702

(58) Field of Classification Search ..... 51/307, 51/309; 428/156, 174, 216, 336, 472, 697, 428/698, 699, 701, 702; 407/119; 204/192.1, 204/192.15; 427/348, 368, 419.1, 419.2, 427/419.3, 419.7

See application file for complete search history.

(56) References Cited

U.S. PATENT DOCUMENTS

| | | | | |
|---|---|---|---|---|
| 4,746,563 | A * | 5/1988 | Nakano et al. | 428/216 |
| 5,310,607 | A | 5/1994 | Schulz et al. | |
| 5,861,210 | A * | 1/1999 | Lenander et al. | 428/702 |
| 5,863,640 | A * | 1/1999 | Ljungberg et al. | 428/336 |
| 5,879,823 | A | 3/1999 | Prizzi et al. | |
| 6,062,776 | A * | 5/2000 | Sandman et al. | 407/119 |
| 6,210,726 | B1 | 4/2001 | Schiller et al. | |
| 6,214,287 | B1 | 4/2001 | Waldenström | |
| 6,250,855 | B1 | 6/2001 | Persson et al. | |
| 6,273,930 | B1 | 8/2001 | Waldenström | |
| 6,333,099 | B1 * | 12/2001 | Strondl et al. | 428/216 |
| 6,342,291 | B1 * | 1/2002 | Jonsson et al. | 428/216 |
| 6,565,957 | B2 * | 5/2003 | Nakamura et al. | 428/216 |
| 6,632,514 | B1 * | 10/2003 | Sulin et al. | 428/701 |
| 6,682,274 | B2 | 1/2004 | Votsch et al. | |
| 6,689,450 | B2 * | 2/2004 | Ruppi | 428/698 |
| 6,720,095 | B2 * | 4/2004 | Ruppi et al. | 428/702 |
| 6,884,497 | B2 * | 4/2005 | Sulin et al. | 51/307 |
| 7,094,479 | B2 * | 8/2006 | Sato et al. | 428/336 |
| 7,153,562 | B2 * | 12/2006 | Rodmar et al. | 428/701 |
| 7,163,735 | B2 * | 1/2007 | Ruppi | 428/698 |
| 2007/0059559 | A1 | 3/2007 | Schier | |

FOREIGN PATENT DOCUMENTS

| | | |
|---|---|---|
| EP | 1 193 328 | 4/2002 |

OTHER PUBLICATIONS

O. Knotek et al., "Process and Advantage of Multicomponent and Multilayer PVD Coatings", Surface and Coatings Technology, 59, pp. 14-20, 1993.

Sukehiro Shinzato et al., "Internal Stress in Sputter-Deposited $Al_2O_3$ Films", Thin Solid Films, 97, pp. 333-337, 1982.

* cited by examiner

*Primary Examiner*—Archene Turner
(74) *Attorney, Agent, or Firm*—Drinker Biddle & Reath LLP

(57) ABSTRACT

The present invention describes a cutting tool with improved properties for metal machining having a substrate of cemented carbide and a hard and wear resistant coating on the surface of said substrate. The coating is deposited by Physical Vapor Deposition (PVD). The coating is composed of metal nitrides in combination with alumina ($Al_2O_3$). The coating is composed of a laminar multilayered structure. The insert is further treated to have different outer layers on the rake face and flank face respectively.

20 Claims, No Drawings

PVD COATED CUTTING TOOL

BACKGROUND OF THE INVENTION

The present invention relates to a cutting tool with improved properties for metal machining having a substrate of cemented carbide and a hard and wear resistant coating on the surface of said substrate. The coating is deposited by Physical Vapor Deposition (PVD). The coating is composed of metal nitrides in combination with alumina ($Al_2O_3$). The coating is composed of a laminar multilayered structure. In order to optimize performance, the insert is further treated to have different outer layers on the rake face and flank face, respectively.

Modern high productivity tools for chip forming machining of metals requires reliable tools with excellent wear properties. Since the end of 1960s it is known that tool life can be significantly improved by applying a suitable coating to the surface of the tool. The first coatings for wear applications were made by Chemical Vapor Deposition (CVD) and this coating technique is still widely used for cutting tool applications. Physical Vapor Deposition (PVD) was introduced in the mid 1980s and has since then been further developed from single coatings of stable metallic compounds like TiN or Ti(C,N) to include multicomponent and multilayer coatings also including metastable compounds like (Ti,Al)N or non metallic compounds like $Al_2O_3$.

RF-sputtering of alumina on cemented carbide cutting tools using deposition temperatures up to 900° C. is described in Shinzato et al., *Thin Sol. Films,* 97 (1982) 333-337. The use of PVD coatings of alumina for wear protection is described in Knotek et al., *Surf Coat. Techn.,* 59 (1993) 14-20, where the alumina is deposited as an outermost layer on a wear resistant carbonitride layer. The alumina layer is said to minimize adhesion wear and acts as a barrier to chemical wear. U.S. Pat. No. 5,879,823 discloses a tool material coated with PVD alumina as one or two out of a layer stack, the non-oxide layers being e.g. TiAl containing. The tool may have an outer layer of TiN. The $Al_2O_3$ may be of alpha, kappa, theta, gamma or amorphous type. Alumina coated tools where the oxide polymorph is of gamma type with a 400 or 440 texture are disclosed in U.S. Pat. No. 6,210,726. U.S. Pat. No. 5,310,607 discloses PVD deposited alumina with a content of >5% Cr. A hardness of >20 GPa and a crystal structure of alpha phase is found for Cr contents above 20%. No Cr addition gives amorphous alumina with a hardness of 5 GPa.

Most coated tools today have a top layer of a goldish TiN to make it easy to differentiate by the naked eye between a used and an unused cutting edge eye. TiN is not always the preferred top layer especially not in applications where the chip may adhere to the TiN layer. Partial blasting of coatings is disclosed in EP-A-1193328 with the purpose to enable wear detection at the same time as the beneficial properties of the underlying coating are retained. Wear on the rake face is mostly chemical in nature and requires a chemically stable compound whereas wear on the flank face is mostly mechanical in nature and requires a harder and abrasive resistant compound.

OBJECTS AND SUMMARY OF THE INVENTION

It is an object of the present invention is to provide an improved cutting tool composition with a multilayer coating.

It is a further object of the present invention to further improve the performance of PVD coated cutting tools using the concept of different outer layers on the rake and flank face respectively.

In one aspect of the invention, there is provided a PVD coated cemented carbide insert having an upper face (rake face), an opposite face and at least one clearance face intersecting said upper and opposite faces to define cutting edges wherein the cemented carbide has a composition of from about 86 to about 90 weight % WC, from about 1 to about 2 weight % (Ta,Nb)C and from about 8 to about 13 weight % Co, and coated with a hard layer system, having a total thickness of from about 3 to about 30 μm, comprising a first layer of (Ti,Al)N with a thickness of from about 1 to about 5 μm, an alumina layer with a thickness of from about 1 to about 4 μm, a ((Ti,Al)N+alumina)*N multilayer, where N≧2, with a thickness of less than about 0.5 μm, and a ZrN layer with a thickness of less than about 1 μm, the ZrN-layer missing on the rake face and on the edge line wherein the (Ti,Al)N-layers preferably have an atomic composition of Ti/Al of greater than about 60/40 and less than about 70/30.

In another aspect of the invention, there is provided a method of making a coated cutting tool insert having an upper face (rake face), an opposite face and at least one clearance face intersecting said upper and opposite faces to define cutting edges, comprising the following steps: providing a cemented carbide substrate with a composition of from about 86 to about 90 weight % WC, from about 1 to about 2 weight % (Ta,Nb)C and from about 8 to about 13 weight % Co, depositing onto the cemented carbide substrate by PVD, a hard layer system with a total thickness of from about 3 to about 30 μm, and comprising a first layer of (Ti,Al)N with a thickness of from about 1 to about 5 μm, an alumina layer with a thickness of from about 1 to about 4 μm, a ((Ti,Al)N+alumina)*N multilayer, where N≧2, with a thickness of less than about 0.5 μm, and an outermost ZrN layer with a thickness of less than about 1 μm, wherein the (Ti,Al)N-layers preferably have an atomic composition of Ti/Al greater than about 60/40 and less than about 70/30, and removing said ZrN-layer on the rake face and on the edge line by a post-treatment.

DETAILED DESCRIPTION OF THE INVENTION

The coating, preferably made by PVD, has a (Ti,Al)N-compound next to the substrate, an alumina layer on top of the (Ti,Al)N-layer and at least two further alternating layers of (Ti,Al)N and alumina and an outermost layer of ZrN. The ZrN layer is removed on the rake face in a post treatment, preferably blasting or brushing. For complete removal of the ZrN layer on the rake face several repeated brushings or blastings are often necessary. An incomplete removal often results in local welding of the ZrN residuals to the chip which reduces tool life. In order to reduce the adherence of the top ZrN layer, an intermediate layer of substoichiometric $ZrN_{1-x}$ is deposited on the alumina layer, underneath the ZrN layer. The substoichiometric $ZrN_{1-x}$, has a reduced strength and facilitates the removal of the top ZrN layer.

According to the present invention there is now provided a cutting tool insert, having an upper face (rake face), an opposite face and at least one clearance face intersecting said upper and opposite faces to define cutting edges, comprising a cemented carbide substrate and a hard layer system. The cemented carbide has a composition of from about 86 to about 90 weight % WC, from about 1 to about 2 weight % (Ta,Nb)C and from about 8 to about 13 weight % Co, preferably from about 88 to about 89 weight % WC, from about 1.2 to about 1.8 weight % (Ta,Nb)C and from about 10 to about 11 weight % Co. The hard layer system has a total thickness of from about 3 to about 30 μm, and comprises a first layer of (Ti,Al)N with a thickness of from about 1 to about 5, preferably from about 2 to about 4 μm, an alumina layer, preferably γ-alumina, with a thickness of from about 1 to about 4 preferably from about 1 to about 2 μm, a ((Ti,Al)N+alumina)*N multilayer, where N≧2 with a thickness of less than about 0.5 μm, preferably from about 0.1 to about 0.3 μm, preferably a thin, preferably less than about 0.1 μm, layer of substoichiometric $ZrN_{1-x}$, preferably x=from about 0.01 to about 0.1 and a ZrN layer with a thickness of from about less than 1 μm, preferably from about 0.1 to about 0.6 μm, the ZrN-layer missing on the rake face and on the edge line wherein the (Ti,Al)N-layers preferably have an atomic composition of Al/Ti of greater than about 60/40 to less than about 70/30 most preferably Al/Ti is about 67/33.

The present invention also relates to a method of making a coated cutting tool insert, having an upper face (rake face), an opposite face and at least one clearance face intersecting said upper and opposite faces to define cutting edges, comprising the following steps:

providing a cemented carbide substrate with a composition of from about 86 to about 90 weight % WC, from about 1 to about 2 weight % (Ta,Nb)C and from about 8 to about 13 weight % Co, preferably from about 88 to about 89 weight % WC, from about 1.2 to about 1.8 weight % (Ta,Nb)C and from about 10 to about 11 weight % Co;

depositing onto the cemented carbide substrate, using PVD methods, a hard layer system with a total thickness of from about 3 to about 30 μm, and comprising a first layer of (Ti,Al)N with a thickness of from about 1 to about 5 preferably from about 2 to about 4 μm, an alumina layer, preferably 7-alumina, with a thickness of from about 1 to about 4 preferably from about 1 to about 2 μm, a ((Ti,Al)N+alumina)*N multilayer, where N≧2 with a thickness of less than about 0.5 μm, preferably from about 0.1 to about 0.3 μm, preferably a thin, preferably less than about 0.1 μm, layer of substoichiometric $ZrN_{1-x}$, preferably x=from about 0.01 to about 0.1 and an outermost ZrN layer with a thickness of less than about 1 μm, preferably from about 0.1 to about 0.6 μm wherein the (Ti,Al)N-layers preferably have an atomic composition Al/Ti of greater than about 60/40 to less than about 70/30 most preferably Al/Ti is about 67/33.

removing said ZrN-layer on the rake face and on the edge line by a post-treatment, preferably by brushing or blasting.

The invention is additionally illustrated in connection with the following examples, which are to be considered as illustrative of the present invention. It should be understood, however, that the invention is not limited to the specific details of the examples.

Example 1

Cemented carbide inserts ADMT 160608R with the composition 88 weight % WC, 1.5 weight % (Ta,Nb)C and 10.5 weight % Co were coated with PVD-technique according to the following sequences in one process Version A; a layer stack ($Ti_{0.33}Al_{0.67}N$—$Al_2O_3$—$Ti_{0.33}Al_{0.67}N$—$Al_2O_3$—$Ti_{0.33}Al_{0.67}N$—$Al_2O_3$), Version B; a layer stack ($Ti_{0.33}Al_{0.67}N$—$Al_2O_3$)

Version C; a $Ti_{0.33}Al_{0.67}N$ layer.

The inserts were tested in a dry shoulder milling application.

Work piece material: Martensitic stainless steel X90CrMoV18 (1.4112).

Cutting speed: 140 m/min

Tool life criteria: Number of produced parts

TABLE 1

| Tool life parts produced after edge milling | | | |
|---|---|---|---|
| | Coating | | |
| | $Ti_{0.33}Al_{0.67}N$ | $Ti_{0.33}Al_{0.67}N$—$Al_2O_3$ | 3 × ($Ti_{0.33}Al_{0.67}N$—$Al_2O_3$) |
| Tool life parts | 3 | 4 | 7 |

The result shows the effect of an increasing layer thickness on tool life in edge milling.

EXAMPLE 2

Cemented carbide inserts ADMT 160608R with the composition 88 weight % WC, 1.5 weight % (Ta,Nb)C and 10.5 weight % Co were coated with PVD-technique according to the following sequence in one process: 3 μm (Ti,Al)N (Al/Ti 67/33%), 1,5 μm nanocrystalline γ-alumina, 0.2 μm (Ti,Al)N (Al/Ti 67/33%), 0.2 μm nanocrystalline γ-alumina, 0.1 μm (Ti,Al)N (Al/Ti 67/33%), 0.1 μm nanocrystalline γ-alumina, 0.1-0.5 μm ZrN.

The top layer of ZrN was blasted off on the rake face using alumina in a wet blasting process.

Both blasted and unblasted inserts were used to edge mill a Ti-alloy (toughness 1400 N/mm$^2$).

The maximum flank wear was measured after a cutting distance of 890 mm with the following result.

TABLE 2

| Wear (mm) after edge milling | | |
|---|---|---|
| | Untreated | ZrN removed on rake face |
| Maximum flank wear | 0.40-0.45 | 0.15-0.23 |
| Maximum radius wear | 0.23-0.3 | 0.10-0.13 |

It is clearly shown that the removal of ZrN on the top rake face leads to a considerably lower wear.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A PVD coated cemented carbide insert having an upper face (rake face), an opposite face and at least one clearance face intersecting said upper and opposite faces to define cutting edges wherein the cemented carbide has a composition of from about 86 to about 90 weight % WC, from about 1 to about 2 weight % (Ta,Nb)C and from about 8 to about 13 weight % Co, and wherein the cemented carbide insert is coated with a hard layer system, having a total thickness of from about 3 to about 30 μm, comprising a first layer of (Ti,Al)N with a thickness of from about 1 to about 5 μm, an alumina layer, with a thickness of from about 1 to about 4 μm, a ((Ti,Al)N+alumina)*N multilayer, where N≧2, with a thickness of each ((Ti,Al)N+alumina) layer is less than about 0.5 μm, and a ZrN layer with a thickness of less than about 1 μm, the ZrN-layer missing on the rake face and on the edge line.

2. A cutting tool insert of claim 1 where in there is a thin layer of substoichiometric $ZrN_{1-x}$ underneath the top layer of ZrN.

3. A cutting tool insert of claim 1 wherein the cemented carbide has a composition of from about 86 to about 89 weight % of WC, from about 1.2 to about 1.8 weight % (Ta,Nb)C and from about 10 to about 11 weight % Co.

4. A cutting tool insert of claim 1 wherein the said first layer has a thickness of from about 2 to about 4 μm.

5. A cutting tool insert of claim 1 wherein said alumina is γ-alumina.

6. A cutting tool insert of claim 1 wherein the thickness of each ((Ti,Al)N+alumina) layer is from about 0.1 to about 0.3 μm.

7. A cutting insert of claim 1 wherein said ZrN layer has a thickness of from about 0.1 to about 0.6 μm.

8. A cutting tool insert of claim 1 wherein at least one of the (Ti,Al)N layers in the insert has an atomic composition of Al/Ti of greater than about 60/40 to less than about 70/30.

9. A cutting tool insert of claim 8 wherein at least one of the (Ti,Al)N layers in the insert has an atomic composition of Al/Ti of about 67/33.

10. A cutting tool insert of claim 1 wherein each of the (Ti,Al)N layers in the insert have an atomic composition of Al/Ti of greater than about 60/40 to less than about 70/30.

11. A cuffing tool insert of claim 10 wherein each of the (Ti,Al)N layers in the insert have an atomic composition of Al/Ti of about 67/33.

12. Method of making a coated cutting tool insert, having an upper face (rake face), an opposite face and at least one clearance face intersecting said upper and opposite faces to define cuffing edges, comprising the following steps providing a cemented carbide substrate with a composition of from about 86 to about 90 weight % WC, from about 1 to about 2 weight % (Ta,Nb)C and from about 8 to about 13 weight % Co, depositing onto the cemented carbide substrate by PVD, a hard layer system with a total thickness of from about 3 to about 30 μm, and comprising a first layer of (Ti,Al)N with a thickness of from about 1 to about 5 μm, an alumina layer with a thickness of from about 1 to about 4 μm, a ((Ti,Al)N+alumina)*N multilayer, where N≧2 with a thickness of each ((Ti,Al)N+alumina) layer is less than about 0.5 μm, and an outermost ZrN layer with a thickness of less than about 1 μm, and removing said ZrN-layer on the rake face and on the edge line by a post-treatment.

13. Method according to claim 12 further comprising depositing a thin layer of substoichiometric $ZrN_{1-x}$ on top of the ((Ti,Al)N+alumina)*N multilayer.

14. A method of claim 12 wherein the cemented carbide has a composition of from about 86 to about 89 weight % of WC, from about 1.2 to about 1.8 weight % (Ta,Nb)C and from about 10 to about 11 weight % Co.

15. A method of claim 12 wherein the said first layer has a thickness of from about 2 to about 4 μm.

16. A method of claim 12 wherein said alumina is γ-alumina.

17. A method of claim 12 wherein the thickness of each ((Ti,Al)N+alumina) layer is from about 0.1 to about 0.3 μm.

18. A method of claim 12 wherein said ZrN layer has a thickness of from about 0.1 to about 0.6 μm.

19. A method of claim 12 wherein at least one of the (Ti,Al)N layers in the insert has an atomic composition of Al/Ti of greater than about 60/40 to less than about 70/30.

20. A method of claim 12 wherein at least one of the (Ti,Al)N layers in the insert has an atomic composition of Al/Ti of about 67/33.

* * * * *